United States Patent [19]

Davis et al.

[11] 4,307,504

[45] Dec. 29, 1981

[54] METAL CLAMP APPLICATOR

[75] Inventors: John D. Davis, Lexington; Jess B. Ferrill, Greensboro; Ronald D. Sizemore, Germantown, all of N.C.

[73] Assignee: AMP Inc., Harrisburg, Pa.

[21] Appl. No.: 150,375

[22] Filed: May 15, 1980

[51] Int. Cl.[3] ..... H01R 43/04

[52] U.S. Cl. ..... 29/566.3; 29/753; 72/452

[58] Field of Search ..... 29/566.3, 748–753, 29/761; 72/452, 410

[56] References Cited

U.S. PATENT DOCUMENTS

| | | | |
|---|---|---|---|
| 3,911,712 | 10/1975 | Wustinger et al. | 72/324 |
| 4,127,315 | 11/1978 | McKee | 339/103 B |
| 4,159,567 | 5/1979 | Schwalm | 29/759 |
| 4,193,187 | 3/1980 | Haller et al. | 29/749 |

*Primary Examiner*—Carl E. Hall

*Attorney, Agent, or Firm*—Gerald K. Kita

[57] ABSTRACT

The disclosure relates to apparatus for installing a clamp portion of an electrical connector to a multiconductor communication cable. The apparatus is used in conjunction with apparatus for trimming, and connecting, wires to electrical terminals of the connector.

9 Claims, 10 Drawing Figures

METAL CLAMP APPLICATOR

FIELD OF THE INVENTION

The present invention relates to automated installation of an electrical connector to a multiconductor communication cable, and, more particularly, to apparatus which inserts the cable into a metal clamp, mounted in an electrical connector, and which closes the clamp against the cable to provide a rugged clamp connection.

BACKGROUND OF THE PRIOR ART

Electrical connectors, such as the type disclosed in U.S. Pat. No. 3,760,335, connect or splice together separate lengths of multiconductor communication cable. The connectors are installed at a factory on each end of a length of cable. The resulting cable assembly is stored and then transported to a work site where the cable assembly is to be utilized. The connector must be securely fastened to the cable to withstand rough handling. U.S. Patent application, Ser. No. 11,338, filed 12/12/79, discloses a metal clamp for an electrical connector which provides a rugged, clamped connection of a connector to a cable. The clamp is designed for quick, automated installation merely by closing spaced apart arms of the clamp against the cable. The present invention relates to automation of this simple operation, and to performance thereof contemporaneously with automated connection of the individual conductors of the cable with electrical terminals in the connector. Apparatus is disclosed in U.S. Patent application, Ser. No. 929,742, filed 7/31/78, having a work station which mounts the connector, tooling for trimming, then inserting electrical conductors of a multiconductor communication cable into successively arranged terminals of the connector, and a motor drive for transporting said tooling along the connector and for precisely aligning the tooling with each terminal during trimming and inserting a conductor in the terminal.

SUMMARY OF THE INVENTION

The present invention resides in apparatus which grasps a cable and inserts the same in between spaced apart arms of a metal clamp provided on an electrical connector. The apparatus then forcibly closes the clamp arms toward each other and against the cable to provide a rugged, secure clamp connection. This apparatus is advantageously incorporated with apparatus, which trims and inserts the individual conductors of the cable into electrical terminals of an electrical connector on which the clamp is mounted. For safety and convenience, the apparatus must be of low profile, i.e. height, above a work station on which the connector is positioned. In operation, an operator locates the cable near the clamp of the connector. The apparatus itself inserts the cable in the clamp and then closes the clamp against the cable to provide a secure connection. Then additional apparatus trims and inserts the individual conductors of the cable in the terminals of the connector while the connector remains on the work station. The rugged, secure, clamp connection of the cable to the connector prevents separation of the cable from the connector.

OBJECTS

An object of the invention is to provide apparatus for inserting a multiconductor communication cable in between spaced apart arms of a clamp, and for closing the arms against the cable to provide a rugged, secure, clamp connection.

Another object is to provide a low profile apparatus for inserting a cable into a clamp, and for closing the clamp against the cable to establish a rugged, secure, clamp connection.

Another object is to combine apparatus, which trims conductors and inserts the conductors into electrical terminals of an electrical connector, with additional apparatus, of low profile, which inserts a multiconductor electrical cable into a clamp, and which closes the clamp against the cable to establish a rugged, secure, clamp connection.

Other objects and advantages of the present invention will become apparent from the following detailed description taken in conjunction with the accompanying drawings.

DRAWINGS

DETAILED DESCRIPTION OF THE ACCOMPANYING DRAWINGS

Figure 1:
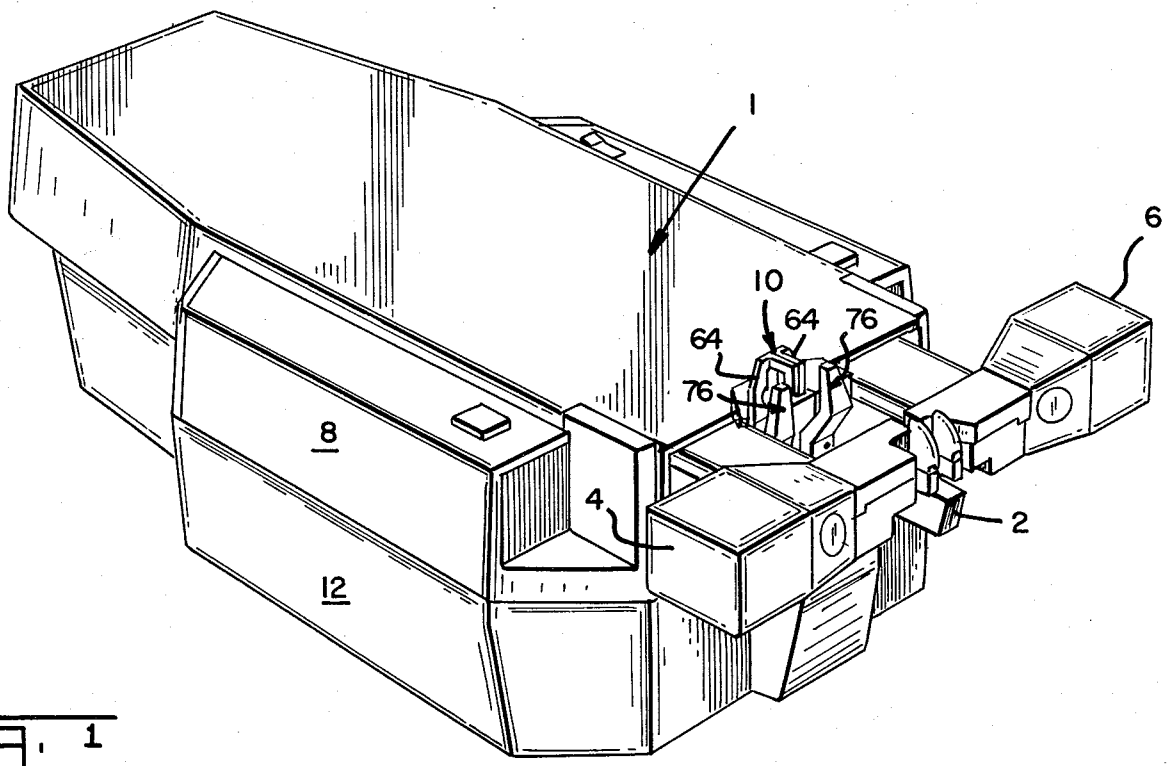
FIG. 1 is a perspective of a conductor trimming and inserting apparatus combined with a low profile apparatus, according to the invention, for inserting a cable into a clamp and for closing the clamp on the cable.

FIG. 1 illustrates, generally at 1, a conductor trimming and inserting apparatus, having a work station or anvil 2, conductor trimming and inserting mechanisms 4, 6, and a housing 8 which contains a motor drive for operating the mechanisms 4 and 6. Further details of the apparatus 1 are set forth in U.S. Patent application, Ser. No. 929,742. A cable inserting and clamp closing apparatus according to the present invention is shown generally at 10, elevated in respect to the mechanisms 4, 6 and the work station or anvil 2. The motor drive for the apparatus 10 is contained in a housing 12 advantageously combined in stacked relationship under the housing 8. The apparatus 10 is conveniently located with respect to the work station 2 and projects with only a slightly elevated profile in respect to the mechanisms 4 and 6.

Figure 2A:
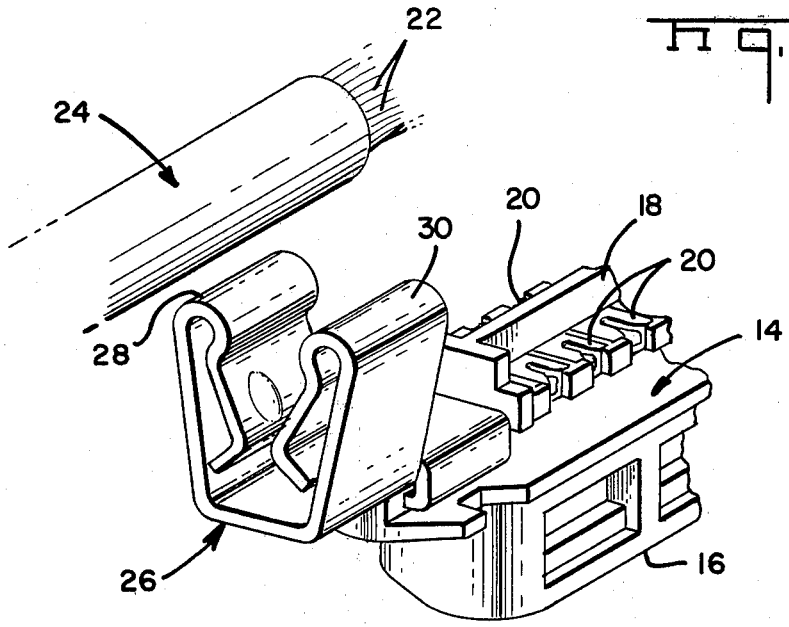
FIG. 2A is a fragmentary perspective of a clamp and connector mounted on the work station of FIG. 2.

FIG. 2A shows an electrical connector 14, either a plug type or receptacle type, as described in U.S. Pat. No. 3,760,335. The connector 14 includes a connector mating side 16 and a conductor connecting side 18, having two rows of electrical terminals 20 to which insulated conductors 22, of a multiconductor communication cable 24, are to be connected by the mechanisms 4, 6, of the apparatus 1. The connector 14 is provided at one end with a metal clamp 26, which secures the cable 24 ruggedly to the connector 14. The clamp 26 is of a type having spaced apart arms 28, 30 as disclosed in U.S. Patent application, Ser. No. 11,338. The arms are closed toward each other by the apparatus 10 and remain closed by permanently bending the metal of which the clamp is fabricated.

Figure 2B:
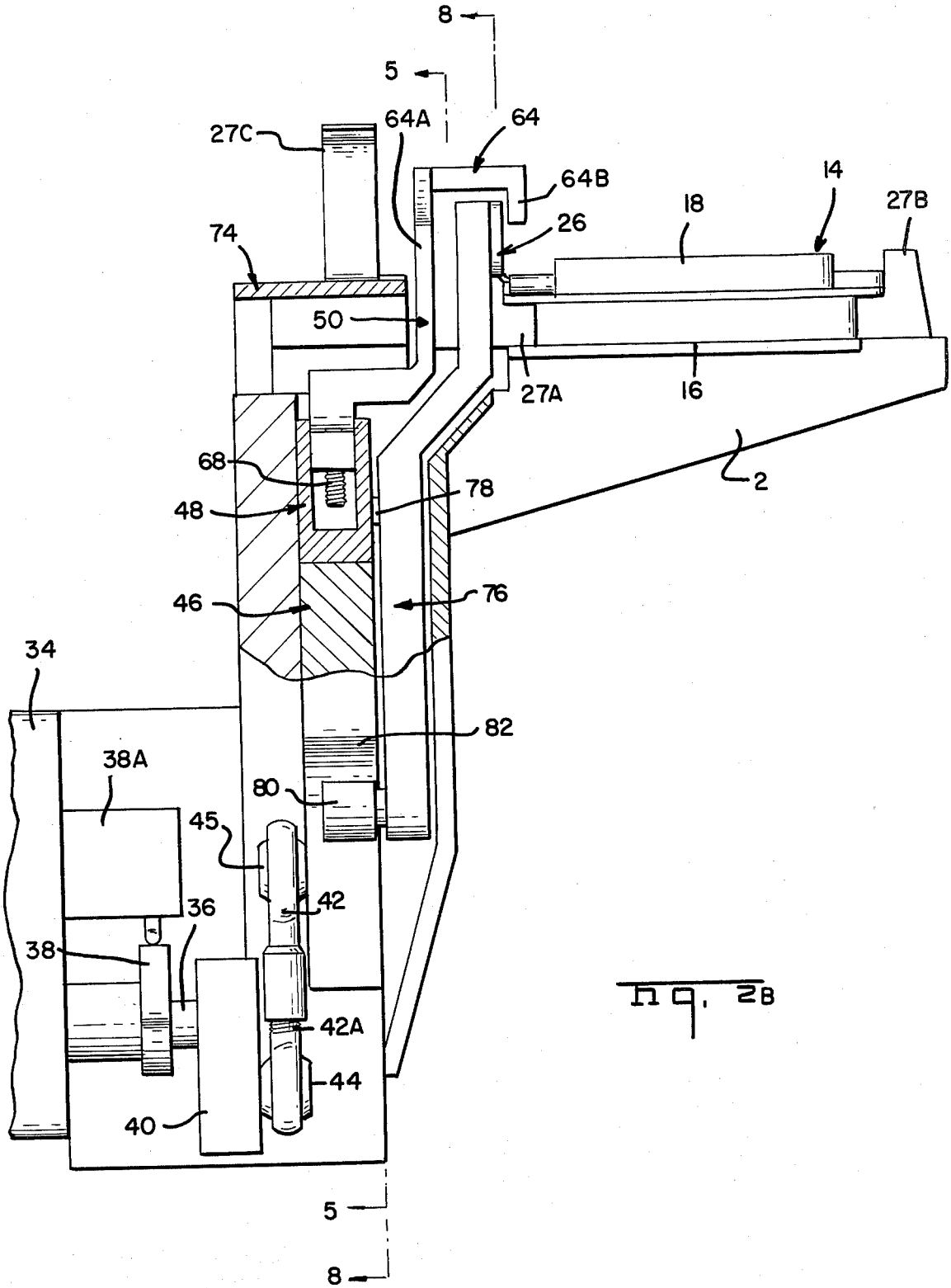
FIG. 2B is an enlarged elevation of apparatus, according to the present invention, in conjunction with a work station of the apparatus shown in FIG. 1.

FIG. 2B shows the connector side 16 mounted against the surface of the work station or anvil 2, with the ends of the connector lodged against heel blocks 27A and 27B. The cable 24 must be positioned by an operator between resilient arms of a clip 27C which is mounted on the anvil and which holds the cable aligned with the cable receiving portion of the clamp 26.

Figure 3:
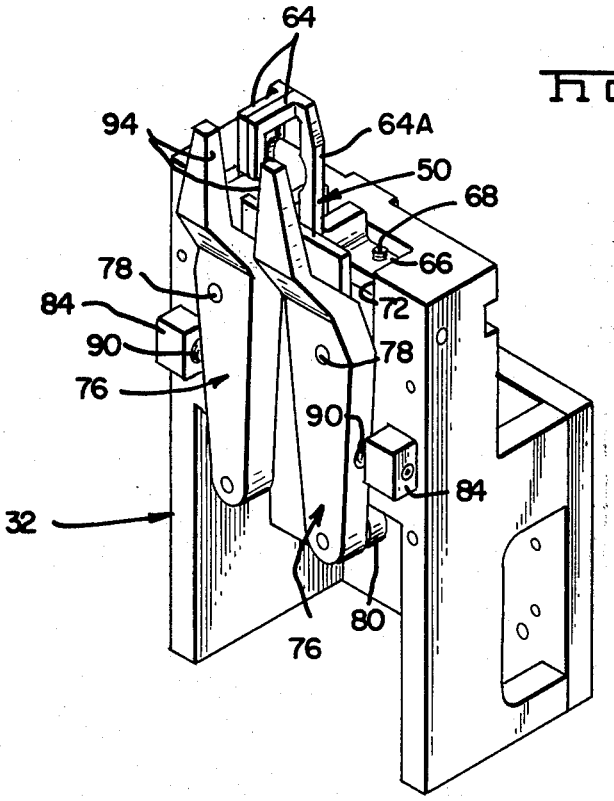
FIG. 3 is an isometric view of the apparatus shown in FIG. 2B.
Figure 4:
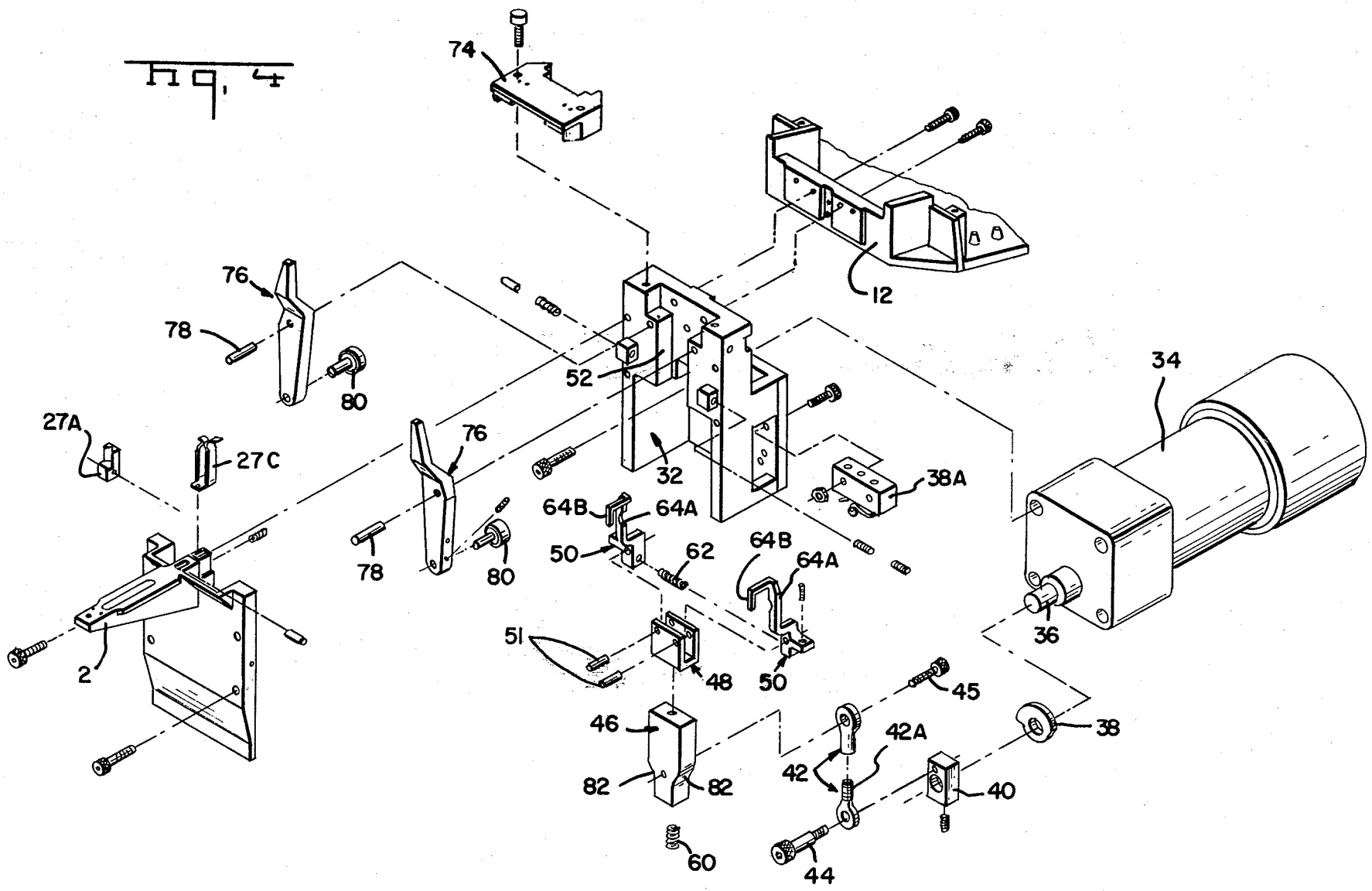
FIG. 4 is an exploded perspective of the apparatus shown in FIG. 3.
Figure 5:
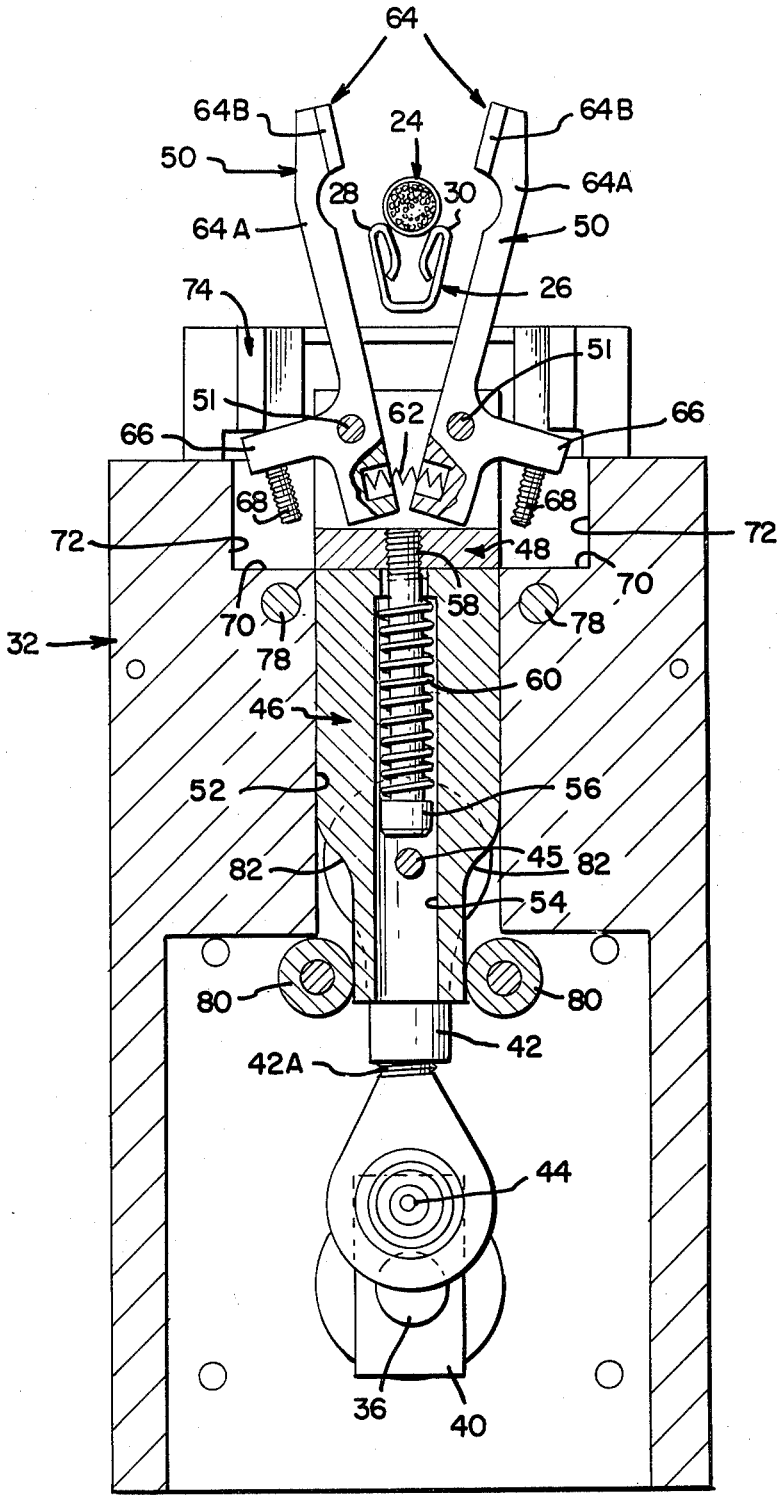
FIG. 5 is a section taken along the line 5—5 of FIG. 2B.
Figure 6:
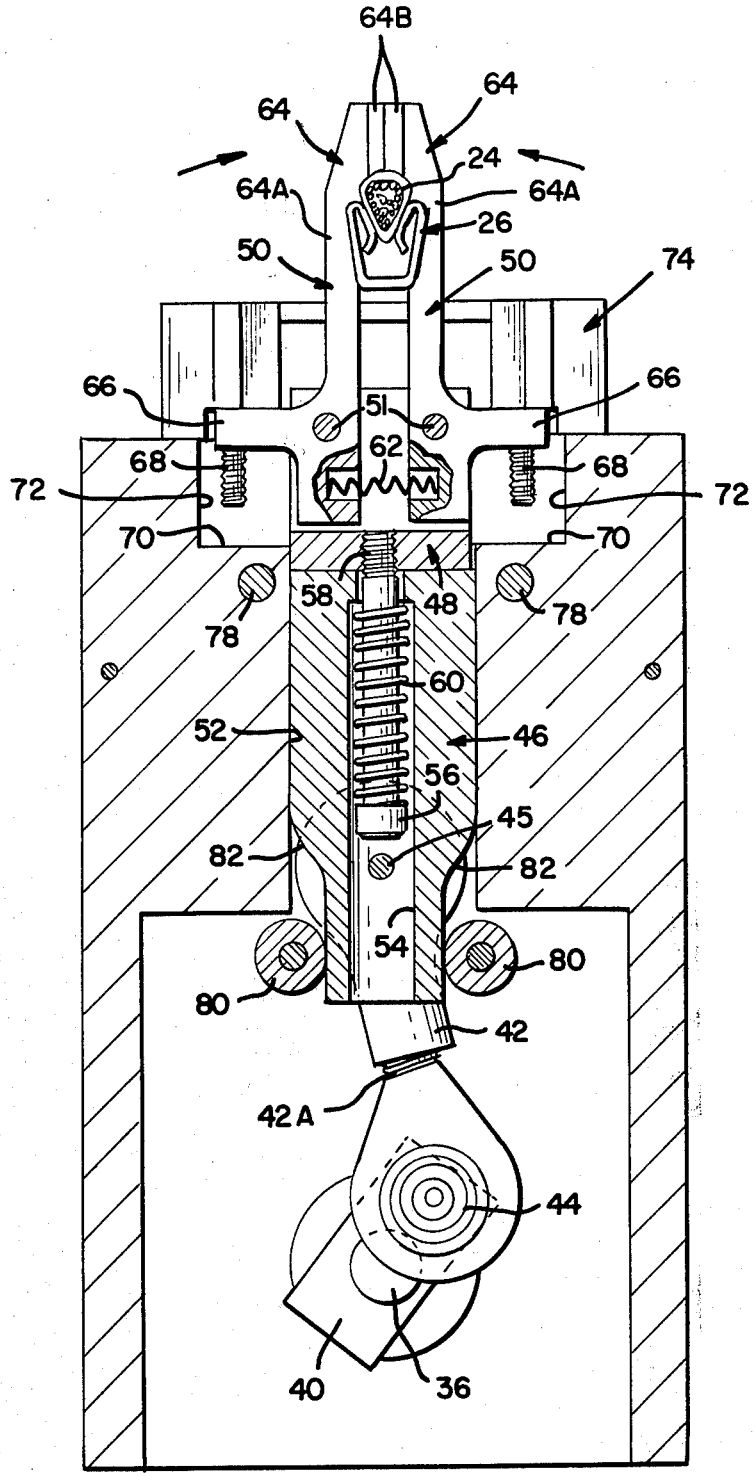
FIGS. 6 and 7 are view similar to FIG. 5 showing the sequence of a cable inserting operation.
Figure 7:
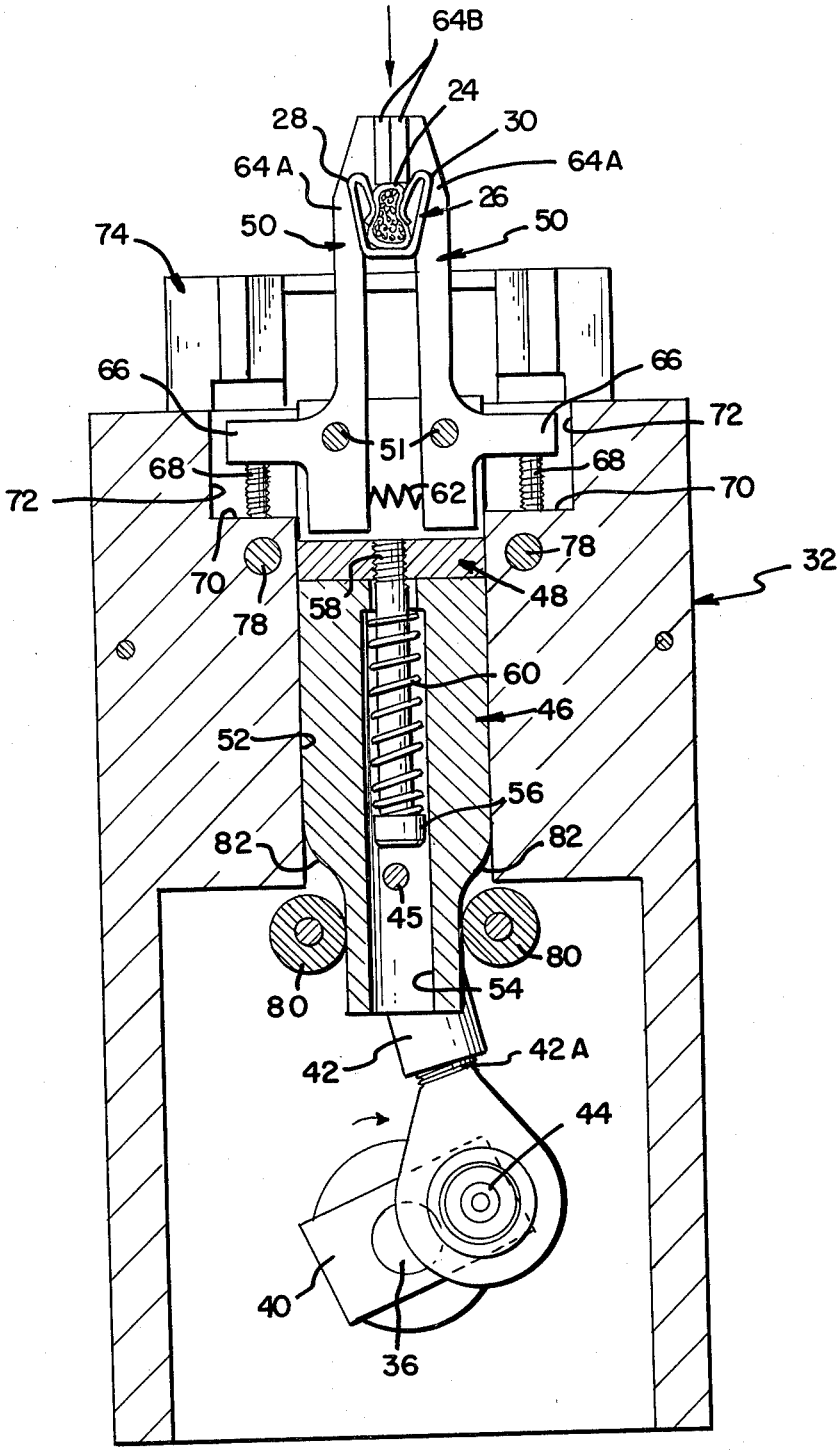

FIGS. 2B, 3 and 4 illustrate the components of the apparatus 10. A frame 32 mounts to the housing 12. A drive motor 34 is mounted in the housing 12 with the output shaft 36 projecting outwardly of the housing, and being provided thereon with an eccentric lobe cam 38 and a crank arm 40. The cam 38 is rotated by the shaft to depress a lever of a lever actuated electrical switch 38A, for a purpose to be described. A swivel arm 42, having universal joints at its ends and having a threadably adjustable length 42A, is connected at one pivotal end by a fastener 44 to the crank arm 40. The other pivotal end of the swivel arm 42 is connected by a fastener 45 to a slide cam 46, shown accompanied by a clevis 48. A pair of cable stuffer arms 50 are pivotably connected by fasteners 51 to the clevis 48 which serves as a carriage for the arms 50. FIGS. 5, 6 and 7 illustrate the slide cam 46 slidably mounted in a vertical passageway 52 of the frame 32. The cam 46 is provided with a stepped diameter bore 54 receiving an elongated bolt 56 having threaded end 58 secured to the clevis 48. A coil spring 60 encircles the bolt and is captivated between the bolt head and the stepped bottom of the bore 54. The bolt provides a "lost motion" link, permitting displacement of the cam 46 relative to the clevis 48, thereby resiliently collasping the spring, for a purpose to be explained.

Yet with reference to FIGS. 5, 6 and 7, the stuffer arms 50 have lowermost ends biased apart by a resilient coil spring 62, which is inset in recesses in the arms 50. The opposite ends 64 of the arms are biased toward each other by the spring. The arms 50 have T-shapes defined by respective lateral extension arms 66, provided with threadably adjustable studs 68 projecting toward respective shoulders 70 defined by cavities 72 in the frame 32. As shown in FIG. 5, a cover 74 is secured to the frame 32 and impinges the arms 66, pivoting the arm ends 64 away from each other, compressing resiliently the coil spring 62. The spaced arm ends 64 freely receive therebetween a portion of the cable 24, in turn, positioned by an operator over the spaced apart arms of the clamp 26. As shown in FIG. 2B, the arms ends 64 are of inverted U-shaped, with depending portions 64A and 64B. The clamp 26 is freely received in the clearance between portions 64A. The portions 64B serve to insert the cable into the clamp, in a manner to be disclosed.

As shown in FIGS. 3, 4, 8 and 9, the apparatus further includes a pair of spaced apart levers 76 having midportions secured pivotally by fasteners 78 to the frame 32 on either side of the cam receiving passageway 52. First lowermost ends of the levers 76 are provided with respective roller followers 80 engaging curviplanar cam surfaces 82 on opposite sides of the cam 46.

The frame 32 is provided with machined bosses 84 facing the first ends of the levers. The bosses have respective threaded bores 86 along which studs 88 are threadably adjustable. Resilient coil springs 90, mounted in the bores, project toward the first ends of the levers 76 and are inset in recesses 92 provided in the levers. The springs continuously urge resiliently the followers 80 against the cam surfaces 82.

Figure 8:
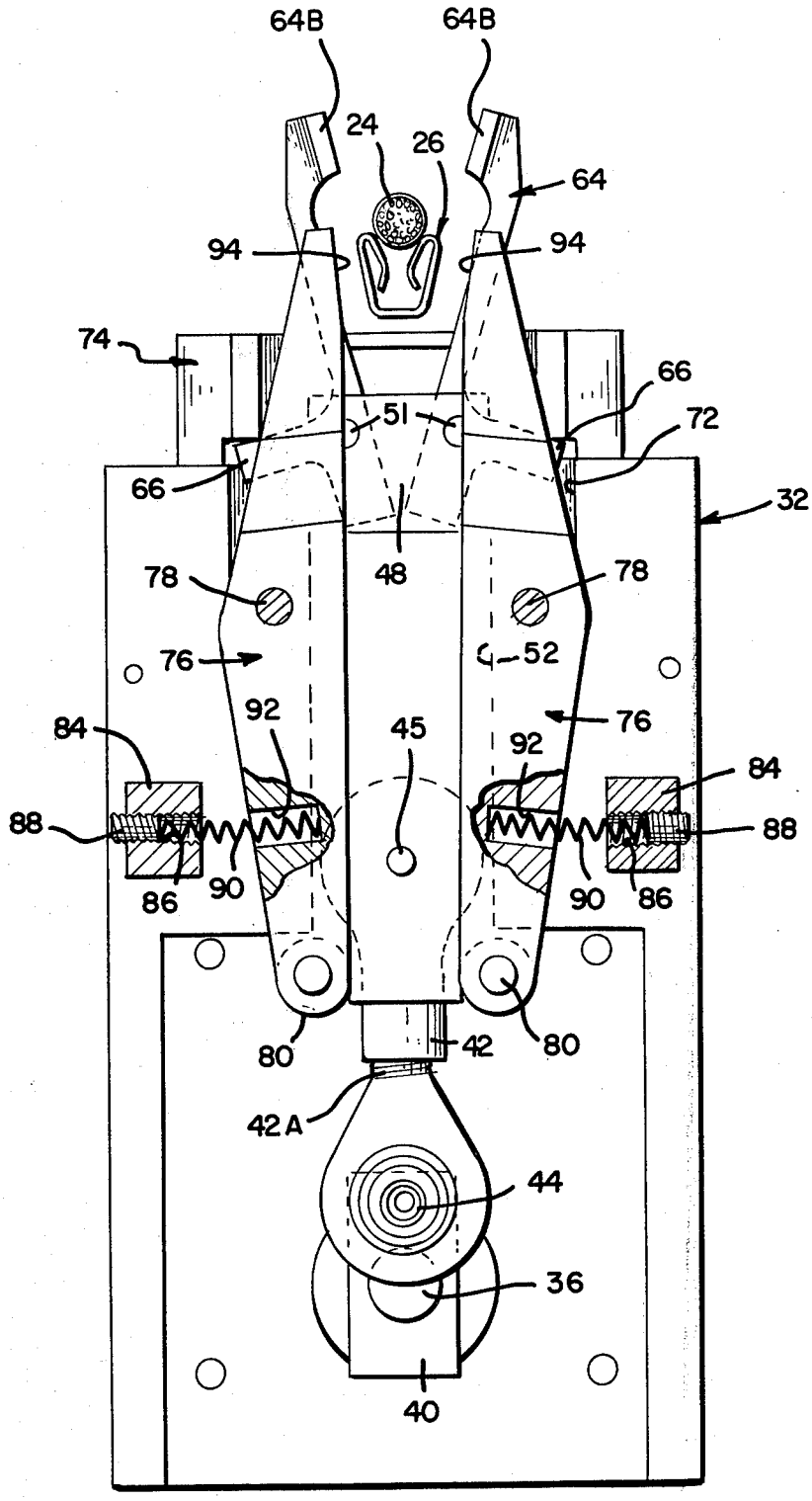
FIG. 8 is a section taken along the line 8—8 of FIG. 2B.

As shown in FIG. 8, when the rollers are against the narrow width portion of the cam 46, jaws 94 on second ends of the levers 76 will be pivoted apart to receive freely therebetween the clamp 26.

In operation, reference is made to FIGS. 2B and 5. An operator mounts a connector 14 on the work station or anvil 2. Next a cable 24 is placed temporarily in the clip 27C which positions the cable lengthwise over the clamp 26, and especially in alignment with the space between the clamp arms 28 and 30. The cable conductors 22 which emanate from the remainder of the cable extend generally over the connector 14 and can be temporarily bent upwardly or aside, out of the way of the connector and the mechanisms 4 and 6. In most occasions, the cable will not drop freely in between the clamp arms 28 and 30, but instead will rest on the arms, in alignment with the space between the arms. This is shown in FIGS. 5 and 8, the figures also illustrating the initial condition of the apparatus 10. Thereby the cable is predictably located in alignment with the space between the arms of the clamp.

The motor 34 is activated, by an operator triggering a start up switch of any well known type, to rotate the shaft 36. At the completion of one revolution, the cam lobe 38 will trigger the lever actuated switch 38A, which switches off the supply of electrical power to the motor 34. During the one revolution, the apparatus 10 is activated to insert the cable in the clamp and to close the clamp arms on the cable. FIG. 6 shows the cam 46 slidably displaced along the passageway to a second, intermediate position, upon rotation of the shaft partway of a complete revolution. The stuffer arms 50 will be displaced in company with the cam, moving the extension arms 66 away from the cover 74, and relieving the pressure of the extension arms against the cover, and allowing the coil spring 62 to expand and cause initial pivoting of the stuffer arms ends 64 toward each other, enclosing and grasping the cable 24 between the portions 64A, and positioning the portions 64B over the cable, in alignment with the cable 24 and with the space between the spaced apart clamp arms 28 and 30.

Figure 9:
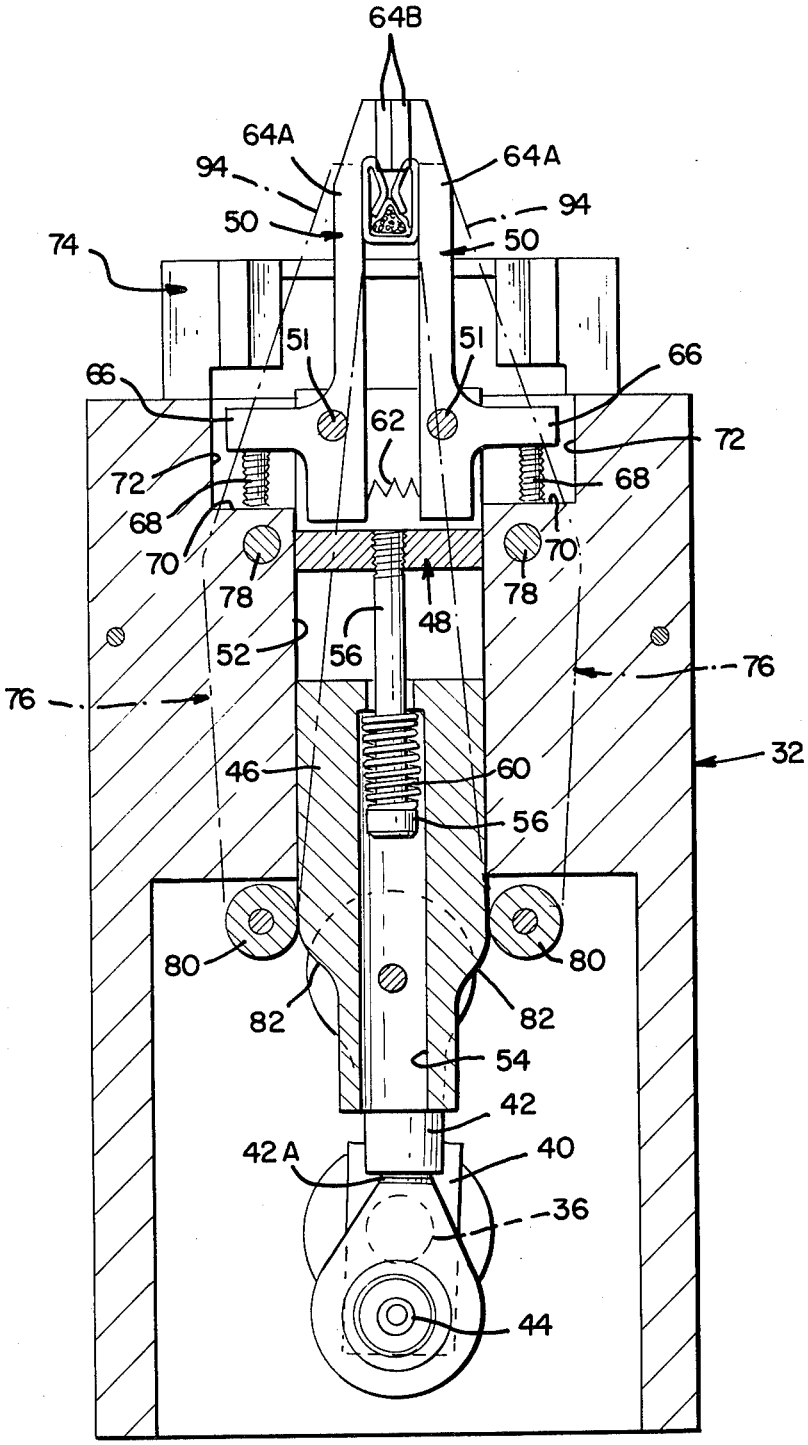
FIG. 9 is a view similar to FIG. 8, showing a clamp closing operation.

FIG. 7 shows the cam displaced to a third, intermediate position, upon additional partway rotation of the shaft. The clevis 48 and the stuffer arm portions 64B are displaced toward the cable and the clamp, forcibly engaging and displacing the cable transversely of its length, thereby inserting and wedging the cable in between the clamp arms 28 and 30. The extension arms 66 are disengaged from the cover 74, and are displaced toward the shoulders 70. The studs 68 are stopped against the shoulders 70 to prevent further displacement of the stuffer arms 50 in company with the cam 46. The cable is held in the clamp by the portions 64B, which, in turn are forcefully biased together and engaged on the cable due to pressure of the studs 68 against the shoulders 70, while the cam is displaced to a fourth position as shown in FIG. 9.

While the cam is displaced to each of its positions as shown in FIGS. 5, 6, 7 and 8, the roller followers 80 remain against a narrow width portion of the cam. When the cam is displaced to its fourth position, the followers 80 traverse the curviplanar cam surfaces 82 to a wider portion of the cam. The followers are biased outwardly in respect to the cam, to pivot the jaws 94 toward each other, to engage the clamp arms 28 and 30, and to close forcibly the clamp arms against the cable 24 to provide a rugged clamp connection thereto. The cam is displaced along the bolt 56, in respect to the clevis 48, and also the stuffer arms 50. The coil spring 60 is compressed resiliently to store energy, which is later expended to return the cam to its initial position relative to the clevis 48. Upon completed revolution of the shaft, the apparatus 10 returns to its initial condition shown in FIG. 5, freeing the cable and clamp. However, the cable 24 remains secured in the closed clamp 26. The operator then is able to trim, and insert, the conductors 22 in the terminals 20 of the connector 14, in the manner disclosed in U.S. Patent application, Ser. No. 929,742. Upon completion of all operations, the assembly of the cable 24 and connector 14 are removed from the apparatus 1 and 10.

Although a preferred embodiment of the present invention is disclosed in detail, other embodiments and modifications thereof which would become apparent to one having ordinary skill in the art are intended to be covered by the spirit and scope of the appended claims.

What is claimed is:

1. A low profile apparatus for inserting a multiconductor communication cable between spaced apart arms of a clamp, and for closing said arms against said cable to provide a rugged, secure, clamp connection, the combination comprising:

a frame slidably mounting a cam, a pair of stuffer arms constructed in response to sliding displacement of said cam to grip therebetween a multiconductor communication cable and to displace said cable transversely of its length to insert said cable in between spaced apart arms of a clamp, and a pair of spaced apart jaws pivotally mounted on said frame and being biased by said cam to pivot toward each other to engage and close forcefully said clamp arms toward each other in secure clamped relationship against said cable.

2. The structure as recited in claim 1, and further including: means connecting said stuffer arms to said cam, so that displacement of said cam causes said stuffer arms to displace said gripped cable transversely of its length until inserted in between said spaced apart clamp arms.

3. The structure as recited in claim 2, wherein said means comprises a linkage having a portion which lengthens to allow displacement of said cam relative to said stuffer arms while said cable remains gripped by said stuffer arms and in between said spaced apart arms of said clamp.

4. The structure as recited in claim 3, and further including:

means on said stuffer arms for impinging said frame and for maintaining said stuffer arms engaged on said cable during displacement of said cam relative to said stuffer arms.

5. The structure as recited in claim 1, wherein, said stuffer arms while in first positions being impinged on said frame and biased apart to receive therebetween said cable and said clamp, said stuffer arms in second positions being disengaged from said frame and free to pivot toward each other, and further including:

means biasing said stuffer arms toward each other to grip said cable when said stuffer arms are in said second positions, said stuffer arms in third positions grasping said cable and positioning said cable in between said clamp arms, said stuffer arms in said third positions having means impinging said frame to bias forcefully said stuffer arms together and engaged on said cable during displacement of said cam to cam said jaws toward each other.

6. The structure as recited in claim 1, wherein said jaws include roller followers engaging and being cammed by said cam, to bias said jaws against said clamp arms.

7. A low profile apparatus for inserting a multiconductor communication cable between spaced apart arms of a clamp, and for closing said arms against said cable to provide a rugged, secure, clamp connection, the combination comprising:

a stationary frame, a cam mounted slidably by said frame, stuffer arms pivotally mounted on a carriage which is joined to said cam, said arms being impinged on said frame and pivoted apart with said carriage in a first position, means continuously biasing said arms toward each other enclosing a multiconductor communication cable when said carriage is displaced from said first position to a second position, said arms while enclosed on said cable being displaced in the same direction as said carriage from said first position to said second position to insert said cable transversely of its length in between a spaced apart pair of clamp arms, means on said arms impinging on said frame to maintain said carriage in said second position and said cable in between said clamp arms, an extensible link joining said carriage and said cam and being extensible upon displacement of said cam relative to said carriage when said carriage is maintained in said second position, a pair of jaws pivotally mounted on said frame and engaging said cam, said jaws being pivoted by said cam, when said cam undergoes said continued displacement, to engage and close said clamp arms toward each other into clamped connection on said cable.

8. The structure as recited in claim 6, wherein, said jaws include roller followers continuously engaging opposite side surfaces of said cam, said surfaces including inclined portions displaced into engagement with said followers when said cam undergoes said continued displacement, so that said followers are pivoted in directions outwardly from said cam to pivot said jaws into engagement with said clamp arms.

9. In apparatus having a work station for mounting an electrical connector, tooling for trimming, then inserting, electrical conductors of a multiconductor cable into successively arranged electrical terminals contained in an electrial connector mounted on said work station and a motor drive for transporting said tooling along said connector and for precisely aligning said tooling with each successive contact during said trimming and said inserting of a conductor into said terminals, the improvement comprising:

a low profile apparatus for inserting a multiconductor communication cable between spaced apart arms of a lamp mounted on said connector, and for closing said arms against said cable to provide a rugged, secure, clamp connection, characterised in that, said low profile apparatus includes:

a frame slidably mounting a cam, a pair of stuffer arms constructed in response to sliding displacement of said cam to grip therebetween a multiconductor communication cable and to displace said cable transversely of its length to insert said cable in between spaced apart arms of a clamp, and a pair of spaced apart jaw pivotally mounted on said frame being biased by said cam to pivot toward each other to engage and close forcefully said clamp arms toward each other in secure clamped relationship against said cable.

* * * * *